United States Patent [19]

Oda et al.

[11] Patent Number: 4,533,444

[45] Date of Patent: Aug. 6, 1985

[54] METHOD OF ELECTROLYTIC TREATMENT ON THE SURFACE OF METAL WEB

[75] Inventors: Kazutaka Oda; Hisao Ohba; Teruo Miyashita; Akira Morita; Masahiro Takahashi, all of Shizuoka, Japan

[73] Assignees: Fuji Photo Film Co., Ltd.; Nippon Light Metal Company Ltd., both of Japan

[21] Appl. No.: 611,288

[22] Filed: May 17, 1984

[30] Foreign Application Priority Data

May 19, 1983 [JP] Japan ..... 58-86619

[51] Int. Cl.[3] ..... C25F 3/02; C25F 3/04; C25F 7/00

[52] U.S. Cl. ..... 204/129.43; 204/211; 204/231; 204/DIG. 9

[58] Field of Search ..... 204/129.43, 206, 211, 204/231, DIG. 9

[56] References Cited

U.S. PATENT DOCUMENTS

| | | | |
|---|---|---|---|
| 2,901,412 | 8/1959 | Mostovych | 204/211 |
| 2,951,025 | 8/1960 | Mostovych | 204/211 |
| 4,087,341 | 5/1978 | Takahashi | 204/129.43 |
| 4,214,961 | 7/1980 | Anthony | 204/211 |
| 4,294,672 | 10/1981 | Ohba | 204/DIG. 9 |
| 4,297,184 | 10/1981 | Dyer | 204/DIG. 9 |
| 4,315,806 | 2/1982 | Arora | 204/129.43 |

*Primary Examiner*—Thomas Tufariello
*Attorney, Agent, or Firm*—Sughrue, Mion, Zinn, Macpeak, and Seas

[57] ABSTRACT

A method of electrolytic treatment on the surface of metal web, such as may be employed to fabricate offset printing plates supports, in which the rate of consumption of graphite electrodes used with the process is remarkably reduced. A current having asymmetric positive and negative half cycles is applied between graphite electrodes disposed in a main cell. A portion of the current of the half cycle having the larger average value is applied to an auxiliary anode electrodes provided in an independent auxiliary cell separated from the graphite electrodes. The auxiliary electrode is made of an insoluble material. By making the current density for anode reaction on the surfaces of the graphite electrodes smaller than the current density for cathode reaction on the surfaces of the graphite electrodes, the consumption rate of the graphite electrodes is greatly reduced.

7 Claims, 5 Drawing Figures

FIG. 2

| | | |
|---|---|---|
| (1) | DIRECT CURRENT WAVEFORM | CURRENT VALUE 0 TIME |
| (2) | ASYMMETRIC ALTERNATE CURRENT WAVEFORM | CURRENT VALUE 0 In Ir TIME |
| (3) | ASYMMETRIC ALTERNATE CURRENT WAVEFORM | CURRENT VALUE 0 In Ir TIME |
| (4) | ASYMMETRIC ALTERNATE CURRENT WAVEFORM | CURRENT VALUE 0 In Ir TIME |
| (5) | ASYMMETRIC ALTERNATE CURRENT WAVEFORM (SQUARE-WAVE) | CURRENT VALUE 0 In Ir TIME |
| (6) | ASYMMETRIC ALTERNATE CURRENT WAVEFORM (SQUARE-WAVE) | CURRENT VALUE 0 In Ir TIME |

METHOD OF ELECTROLYTIC TREATMENT ON THE SURFACE OF METAL WEB

BACKGROUND OF THE INVENTION

The present invention relates to a method of electrolytic treatment on the surface of metal web with which the stability of graphite electrodes used in the electrolytic treatment of a metal plate is remarkably improved.

Examples of a method of applying an electrolytic treatment to the surface of a metal member made of aluminum, iron or the like are the plating method, the electrolytic roughening method, the electrolytic etching method, the anodic oxidation method, the electrolytic coloring method, and the electrolytic satin finishing method, all which have been extensively employed in the art. D.C. sources, power mains A.C. sources, superposed-waveform current sources, and thyristor-controlled special-waveform or square-wave A.C. sources have been employed with these methods in order to meet requirements of quality of the electrolytic treatment or to improve the reaction efficiency. For instance, U.S. Pat. No. 4,087,341 discloses a process in which an A.C. is applied in the electrolytic treatment of an aluminum plate with the voltage applied to the anode electrode being higher than that applied to the cathode electrode, whereby an aluminum substrate for lithographic printing whose surface is electrograined satisfactorily is obtained. When using a regulated A.C., it is essential to employ electrodes which are highly stable. In general, platinum, tantalum, titanium, iron, lead and graphite are employed as electrode materials. Graphite electrodes are widely employed because they are chemically relatively stable and are of low cost.

FIG. 1 shows an example of a conventional continuous electrolytic treatment system for metal webs which utilizes graphite electrodes. In this system. a metal web 1 is introduced into an electrolytic cell 4 while being guided by a guide roll 2, and is conveyed horizontally through the cell while being supported by a roll 3. Finally, the web 1 is moved out of the cell passing around a guide roll 5. The electrolytic cell 4 is divided by an insulator 6 into two chambers in which graphite electrodes are arranged on both sides of the metal web 1. A supply of electrolytic solution 28 is stored in a tank 9. A pump 10 supplies the electrolytic solution 28 to electrolytic solution supplying pipes 11 and 12 which debouch into the electrolytic cell 4. The electrolytic solution thus supplied covers the graphite electrodes 7 and 8 and the metal web and then returns to the tank 9 through a discharging pipe 13. A power source 14 connected to the graphite electrodes 7 and 8 applies a voltage thereto. An electrolytic treatment can be continuously applied to the metal web 1 with this system.

The power source 14 may produce (1) direct current, (2) symmetric alternate current waveform, (3) and (4) asymmetric alternate current waveform, and (5) and (6) asymmetric square-wave alternate current waveform as shown in FIG. 2. In general, in such an A.C. waveform, the average value of the forward current $I_n$ is not equal to the average value of the reverse current $I_r$.

A graphite electrode is considerably stable when used as a cathode electrode. However, when a graphite electrode is used as an anode electrode, it is consumed in the electrolytic solution, forming $CO_2$ by anode oxidation and, at the same time, it decays due to erosion of the graphite interlayers, which occurs at a rate depending on electrolytic conditions. When decay occurs, the current distribution in the electrode changes so that the electrolytic treatment becomes nonuniform. Therefore, the occurrence of such a phenomenon should be avoided in a case where the electrolytic treatment must be done with high accuracy. Accordingly, it is necessary to replace the electrodes periodically. This requirement is a drawback for mass production, and is one of the factors which lowers productivity.

An object of the invention is to provide an electrolytic treatment method in which, based on the properties of graphite, the electrodes are maintained sufficiently stable even in an electrolytic treatment using an asymmetric waveform A.C.

SUMMARY OF THE INVENTION

The inventors have conducted intensive research regarding ways to prevent the consumption of graphite electrodes, and found conditions exist under which graphite electrodes employed in a system using asymmetric waveform A.C. can be stabilized. Specifically, in the electrolytic cell shown in FIG. 1, an asymmetric waveform current ($I_n > I_r$) as shown at (4) in FIG. 2 was used. The forward terminal was connected to the electrode 7 and the reverse terminal to the electrode 8. Under these conditions, an electrolytic treatment was carried out by using a 1% HCl electrolytic bath with a current density of 50 A/dm$^2$ and a frequency of 60 Hz. In this case, the graphite electrode 7 was consumed quickly, while when the connection of the terminals was reversed, the electrode 8 was consumed but not the electrode 7. This means that, for the use of an asymmetric waveform current, the graphite electrode is consumed when $I_{anode} > I_{cathode}$, and it is not consumed when $I_{anode} < I_{cathode}$, where $I_{anode}$ is the current value in the periods in which the graphite electrode electrochemically acts as an anode electrode and $I_{cathode}$ is the current value in the periods in which the graphite electrode electrochemically acts as a cathode electrode.

Based on this stabilization condition, the inventors have developed a novel electrolytic treatment method with which graphite electrodes can be maintained stable with an asymmetric waveform current.

BRIEF DESCRIPTION OF THE DRAWINGS

FIG. 2 is a diagram showing current waveforms for a description of the invention.

DESCRIPTION OF THE PREFERRED EMBODIMENTS

Figure 4:
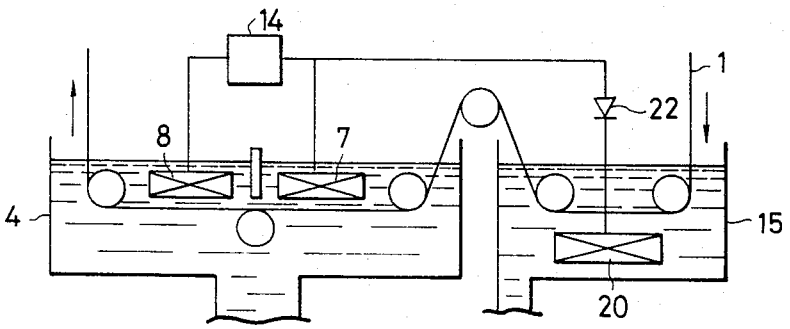
Figure 5:
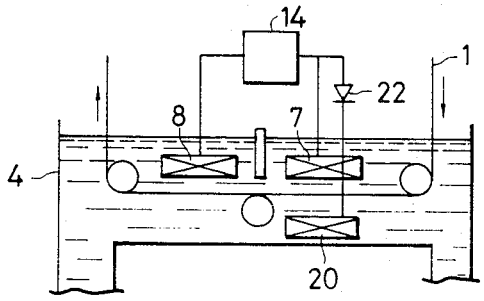

The invention will now be described in detail with reference to preferred embodiments shown in FIGS. 3, 4 and 5.

Figure 1:
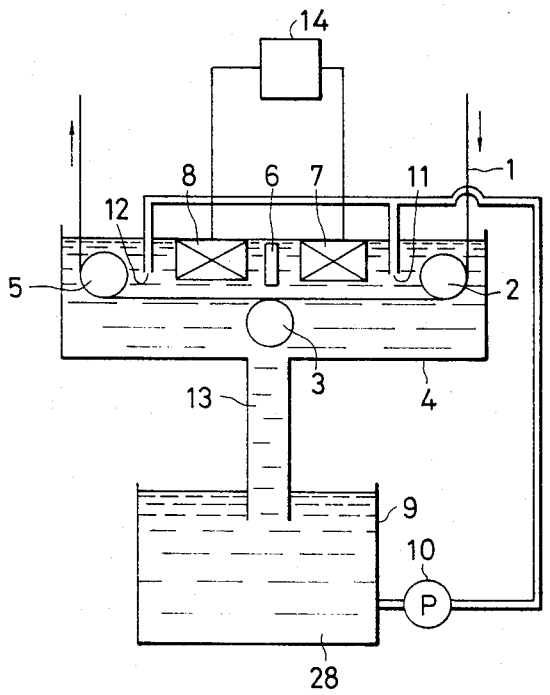
FIG. 1 PRIOR ART
FIG. 1 is an explanatory diagram schematically showing an example of a conventional continuous electrolytic treatment system.
Figure 3:
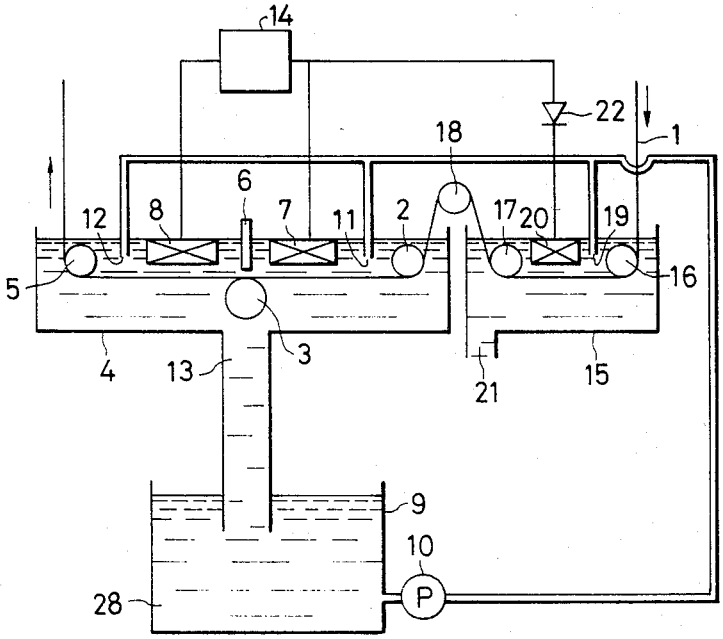
FIGS. 3, 4 and 5 are explanatory diagrams schematically showing examples of continuous electrolytic treatment systems for practicing an electrolytic treatment method according to the invention.

FIG. 3 is an explanatory diagram showing an example of a continuous electrolytic treatment method for metal webs according to the invention. The parts (3) through (6) of FIG. 2 show a variety of asymmetric waveforms which may be employed with the invention.

First, a metal web 1 is passed through an auxiliary electrolytic cell 15 by a guide roll 16, and then through an electrolytic cell 4 via pass rolls 17 and 18 and a guide roll 2. In the electrolytic cell 4, the web 1 is conveyed horizontally by a backing roll 3. Finally, the web is moved out of the cell 4 by a roll 5.

The auxiliary electrolytic cell has an auxiliary electrode, namely, an insoluble anode electrode 20 which is disposed confronting the metal web. The insoluble anode electrode is made of platinum or lead. A pump 10 is used to deliver the electrolytic solution 28 to an electrolytic solution supplying pipe 19 which debouches into the auxiliary electrolytic cell 15. The electrolytic solution thus delivered covers the insoluble anode electrode 20 and the metal web 1 in the cell 15, and is then returned to the tank 9 through a discharging pipe 21.

The electrolytic cell 4 is divided by an insulator 6 into two parts in which respective graphite electrodes 7 and 8 are disposed confronting the metal web 1. The pump 10 supplies the electrolytic solution from the tank 9 to electrolytic solution supplying pipes 11 and 12 opening into the electrolytic cell 4. The electrolytic solution thus supplied is returned through the discharging pipe 13 to the tank 9. In general, the electrolytic solution circulating system includes a heat exchanger and a filter so that the temperature of the electrolytic solution is controlled precisely and foreign matter is removed from the solution.

A power source 14 is provided to apply an asymmetric alternate waveform current, for instance, having a waveform as shown in parts (3) through (6) of FIG. 2, to the electrolytic cell with the electrodes arranged as described. The current waveform is such that $I_n > I_r$ and $I_n = I_r + \alpha$ are maintained, where $I_n$ is the forward current value and $I_r$ is the reverse current value. The positive terminal of the power source 14 is connected to the graphite electrode 7, and is further connected through a thyristor or diode 22 to the insoluble anode electrode 20 in the auxiliary electrolytic cell 16. The negative terminal of the power source is connected to the graphite electrode 8.

In the forward period (positive half cycle) of the current flow, the current $I_n$ is applied to both the graphite electrode 7 and the insoluble anode electrode 20. The current thus applied, which causes an anode reaction to occur on the surfaces of these electrodes, flows through the electrolytic solution to the metal web 1. At the same time, a cathode reaction treatment occurs on the metal web 1 confronting the electrodes. The current $I_n$, which flows in the metal web due to electron conduction, is returned through the electrolytic solution and the graphite electrode 8 to the power source 14. In this operation, the part of the metal web 1 which confronts the electrode 8 is subjected to an anode reaction treatment, while the surface of the electrode 8 is subjected to a cathode reaction treatment.

Assuming that the currents applied to the graphite electrode 7 and the insoluble anode electrode 20 are represented by $I_n'$ and $\beta$, respectively, then control is carried out so as to satisfy the following condition:

$$\beta > \alpha.$$

Such control may be achieved, if a thyristor is employed, by controlling its ON time, or in the case of a diode, by inserting a variable resistor in its circuit. Alternatively, control may be achieved by adjusting the distance between the anode electrode 20 and the metal web 1, or by adjusting the effective area of the anode electrode 20. Further, a separate electrolytic solution circulating tank (not shown) for the auxiliary electrolytic cell 15 can be provided so that the type of electrolytic solution and parameters thereof including its temperature and density can be varied.

In the reverse current period (negative half cycle), the current $I_r$ is supplied from the power source 14 to the graphite electrode 8, and is applied through the electrolytic solution to the metal web 1. In this operation, an anode reaction treatment occurs on the surface of the graphite electrode 8, while a cathode reaction treatment occurs on the surface of the metal web 1. The current $I_r$, which flows in the metal web by electron conduction, is returned through the electrolytic solution and the graphite electrode 7 to the power source 14. In this operation, a cathode reaction treatment occurs on the surface of the graphite electrode 7, while the part of the metal web 1 confronting the graphite electrode 7 is subjected to an anode reaction treatment. In the reverse period, the current $I_r$ does not flow to the anode electrode 20 due to the presence of the thyristor or diode.

In the above-described electrolytic treatment method according to the invention, the electrodes 7 and 8 are considerably stable, being free from oxidation consumption. When the graphite electrode 7 acts as an anode electrode, the current $I_{anode}$ therethrough is $I_n$, and when it acts as a cathode electrode, the current $I_{cathode}$ therethrough is $I_r$. In this case, $I_n = I_r + \alpha$, $I_n = I_n' + \beta$, and $\beta > \alpha$ are established, and therefore $I_n' < I_n$. Accordingly, for the graphite electrode 7, $I_{anode} < I_{cathode}$. Thus, the stabilization condition is satisfied. On the other hand, when the graphite electrode 8 acts as an anode electrode, the current $I_{anode}$ therethrough is $I_r$, and when it acts as a cathode electrode, the current $I_{cathode}$ therethrough is $I_n$. That is, since $I_r < I_n$ is established, the stabilization condition $I_{anode} < I_{cathode}$ is maintained. The auxiliary electrode 20 in the auxiliary electrolytic cell 15 is always stable because it is an insoluble anode electrode, and only an anode reaction occurs therewith.

In electrolytic treatment system shown in FIGS. 4 and 5, in which figures those components which have been described with reference to FIG. 3 are designated by the same reference numerals, the insoluble anode electrode 20 is positioned on one side of the metal web 1 opposite the side on which the graphite electrodes 7 and 8 are disposed. In this sytem, the electrodes are stable. However, an electrolytic reaction also occurs on the rear side of the metal web, thus forming a film thereon. This phenomenon is undesirable. Furthermore, as a part of the current flows to the rear surface, the reaction efficiency is lowered as much. Thus, the employment of these systems may not be economical for some applications, and accordingly, the system shown in FIG. 3 is usually preferable.

As is apparent from the above description, a specific feature of the invention resides in that, in the electrolytic treatment system using an asymmetric waveform A.C. of the invention, a part of the current is applied to the auxiliary electrode so that the graphite electrode stabilization condition $I_{anode} < I_{cathode}$ is established. Another specific feature of the invention resides in that the aforementioned condition is satisfied and the graphite electrodes and the insoluble anode electrode are arranged on the same side of the metal web so that the rear surface of the metal web is protected from unwanted reactions and, accordingly, so that the reaction efficiency is increased. The invention is not limited by the configuration of the electrolytic cell, the number of divisions of th electrolytic cell, the order of arrangement of the electrodes, or the type of the electrolytic cell. In addition, any asymmetric waveform A.C. may be used with the inventive electrolytic treatment method if it satisfies the asymmetric waveform condition $I_n > I_r$.

In order to clarify the effects of the invention, specific examples of the electrolytic treatment method according to the invention will be described.

EXAMPLE 1

In order to prepare an offset printing plate support, a continuous electrolytic graining treatment was applied to an aluminum plate using the electrolytic treatment system shown in FIG. 3. The electrolytic solution employed was a 1% nitric acid solution at a temperature of 35° C., and an asymmetric waveform A.C. current as shown in part (5) of FIG. 2 was employed. The electrodes 7 and 8 were graphite electrodes, and the insoluble anode electrode 20 was made of platinum. After the electrolytic treatment was carried out with a forward current of $I_n = 300$ A and a reverse current $I_r = 270$ A at a treatment rate of 1 m/min for twenty hours, the surfaces of the graphite electrodes were visually inspected for consumption and decay.

In addition, in order to apply a part of the forward current $I_n$ to the insoluble anode electrode, the value $\beta$ was varied by adjusting the effective electrolytic length of the insoluble anode electrode. Also, the frequency was varied in a range of 30 Hz to 90 Hz. However, the results obtained shown in Table 1 following were invariant under such frequency variations. That is, the currents $I_{anode}$ and $I_{cathode}$ and the consumption rate of the graphite electrodes 7 and 8 were as indicated in Table 1, independent of the frequency.

The offset printing plate supports Nos. 3 and 4 in Table 1 had roughened surfaces which were excellent in quality.

EXAMPLE 2

Experiments were carried out under the same conditions as those as Example 1 except that the electrolytic solution was a 1% hydrochloric acid solution and the temperature was 35° C. The stability of the electrodes was the same as that in Table 1.

TABLE 1

| No. | $I_n$ (A) | $I_r$ (A) | $\beta$ (A) | Graphite Electrode (7) | Consumption | Graphite Electrode (8) | Consumption |
|---|---|---|---|---|---|---|---|
| 1 | 300 | 270 | 0 | $I_{anode} > I_{cathode}$ | X | $I_{anode} < I_{cathode}$ | |
| 2 | " | " | 30 | $I_{anode} = I_{cathode}$ | Δ | " | |
| 3 | " | " | 60 | $I_{anode} < I_{cathode}$ | | " | |
| 4 | " | " | 90 | " | | " | |

Legend
: The electrode was not consumed at all.
Δ: The electrode was slightly consumed.
X: The electrode was consumed greatly and the surface decayed.

EXAMPLE 3

In order to fabricate offset printing plate supports, a continuous anodic oxidation treatment was applied to aluminum plates using the electrolytic treatment system as shown in FIG. 3. The electrolytic solution was a 20% nitric acid solution at a temperature of 30° C., and an asymmetric waveform A.C. as indicated in part (4) of FIG. 4 was employed. The electrodes 7 and 8 were graphite electrodes, and the insoluble anode electrode 20 was made of lead. After the electrolytic treatment was carried out with a forward current of $I_n = 60$ A and a reverse current of $I_r = 50$ A at a treatment rate of 1 m/min for twenty hours, the surfaces of the graphite electrodes were visually inspected for consumption and decay. In order to apply a part of the forward current $I_n$ to the insoluble anode electrode, the forward current $I_n$ was varied by adjusting the effective electrolytic length of the insoluble anode electrode. Also, the frequency was varied in the range of 30 Hz to 90 Hz. However, as above, the current $I_{anode}$ and $I_{cathode}$ and the consumption rates of the graphite electrodes as indicated in Table 2 were found to be invariant with respect to frequency.

TABLE 2

| No. | $I_n$ (A) | $I_r$ (A) | $\beta$ (A) | Graphite Electrode (7) | Consumption | Graphite Electrode (8) | Consumption |
|---|---|---|---|---|---|---|---|
| 5 | 60 | 50 | 0 | $I_{anode} > I_{cathode}$ | X | $I_{anode} < I_{cathode}$ | |
| 6 | " | " | 10 | $I_{anode} = I_{cathode}$ | Δ | " | |
| 7 | " | " | 20 | $I_{anode} < I_{cathode}$ | | " | |

Legend
: The electrode was not consumed at all.
Δ: The electrode was slightly consumed.
X: The electrode was consumed greatly and the surface decayed.

As is apparent from the above description, the consumption rate of the electrodes is minimized with the use of the invention, with the result that a continuous electrolytic treatment of high efficiency and which is stable is obtained. Furthermore, secondary effects such as the elimination of the need for inspection and maintenance and a reduction in the manufacturing cost are provided.

While the invention has been described with reference to preferred embodiments, it should be noted that the invention has a wide range of applications.

I claim:

1. A method of electrolytic treatment on the surface of metal web employing graphite electrodes and in which an A.C. having asymmetric positive and negative half cycles is applied between ones of said electrodes to continuously apply an electrolytic treatment to a metal web through an electrolytic solution, the improvement wherein a portion of the current of the one of said half cycles having the larger average value over a complete cycle of said A.C. current is applied to an auxiliary anode electrode provided in addition to said graphite electrodes so that a current density for anode reaction on surfaces of said graphite electrodes is smaller than a current density for a cathode reaction on surfaces of said graphite electrodes.

2. The method as claimed in claim 1, wherein said graphite electrodes and said auxiliary anode electrode are arranged on one side of said metal web and extend in the longitudinal direction of said metal web.

3. The method as claimed in claim 1, wherein said auxiliary anode electrode is disposed in an independent auxiliary cell separated from said graphite electrodes.

4. The method as claimed in claim 1, wherein said auxiliary anode electrode is made of lead.

5. The method as claimed in claim 1, wherein said auxiliary anode electrode is made of platinum.

6. The method as claimed in claim 1, wherein said portion of the current applied to said auxiliary anode electrode is larger than the portion of said current simultaneously applied to said graphite electrodes.

7. The method as claimed in claim 1, wherein a duration of said one half cycle of said current is greater than the duration of the other half cycle of said current.

* * * * *